United States Patent [19]

Strauss et al.

[11] 4,143,301

[45] Mar. 6, 1979

[54] HIGH INTENSITY DISCHARGE LAMP WITH INTEGRAL MEANS FOR ARC EXTINGUISHING

[75] Inventors: Herbert S. Strauss, Paramus; Lawrence Sheinberg, Howell Township, Monmouth County, both of N.J.

[73] Assignee: Duro-Test Corporation, North Bergen, N.J.

[21] Appl. No.: 699,952

[22] Filed: Jun. 25, 1976

Related U.S. Application Data

[63] Continuation-in-part of Ser. No. 577,096, May 13, 1975.

[51] Int. Cl.[2] ..... H01J 61/56; H05B 41/22

[52] U.S. Cl. ..... 315/73; 313/25; 315/49; 315/75

[58] Field of Search ..... 315/49, 58, 67, 69; 315/74, 75, 73; 313/25, 184

[56] References Cited

U.S. PATENT DOCUMENTS 4,013,919 3/1977 Corbley ..... 315/73

FOREIGN PATENT DOCUMENTS 1467050 12/1966 France ..... 315/73

697096 9/1953 United Kingdom ..... 315/119

267753 7/1970 U.S.S.R. ..... 315/74

*Primary Examiner*—Palmer C. Demeo

*Attorney, Agent, or Firm*—Darby & Darby

[57] ABSTRACT

Safety devices for high intensity discharge lamps, having an outer envelope and an inner arc tube in which the arc discharge is produced, for extinguishing the arc in a relatively short period of time. A switching element is placed in series with the current supply to the arc tube and the element opens when the outer envelope is broken. In one embodiment, the switching element is a normally closed thermostatic switch in series with a second filament which is connected in parallel with a first filament. During starting the switching element is closed and both of the filaments are in series with the arc tube and both receive a part of the high starting lamp current. The thermostatic switch opens when the lamp reaches operating temperature so that all of the current passes through the first filament if the envelope breaks causing the first filament to burn out. The switch then closes so that all of the current passes through the second filament causing it to burn out. In another embodiment, a pressure sensitive switch is used which opens the current supply to the arc tube when the envelope breaks.

18 Claims, 5 Drawing Figures

HIGH INTENSITY DISCHARGE LAMP WITH INTEGRAL MEANS FOR ARC EXTINGUISHING

This application is a continuation-in-part of our prior copending application Ser. No. 577,096 filed May 13, 1975, entitled High Intensity Discharge Lamp With Integral Means For Arc Extinguishing which application is assigned to the same assignee.

In our aforesaid prior copending application, safety arrangements are provided for extinguishing the arc in the arc tube of a high intensity discharge (HID) lamp when the outer envelope of the lamp is fully or partly broken. The purpose of extinguishing the arc is to stop the emission of harmful radiation, such as ultraviolet radiation, which normally would be blocked by the outer envelope. The safety arrangements of that application comprise two general types. The first makes use of the chemical reaction of air (principally oxygen) with an oxidizable current conducting element, for example, a tungsten filament, connected in series with the arc tube of the HID lamp. The current conducting element is designed to operate at a sufficiently high temperature to oxidize and burn through when the outer envelope of the lamp is broken or shattered. The flow of current to the arc discharge tube is therefore interrupted, extinguishing the discharge, and preventing emission of the harmful radiation into the surrounding area. The second type of arrangement uses mechanical means, such as a switch, connected in the arc tube circuit. In one arrangement of the aforesaid application, a spring is mounted in contact with the inner surface of the outer envelope. When the outer envelope is broken away the action of spring will cause the switch contacts to separate, interrupting the flow of current to the arc tube and thereby extinguishing the arc.

One embodiment of the oxidizable element mechanism of the foregoing application also uses a thermostatic switch electrically connected in parallel with the element. The thermostatic switch is designed and adjusted to be open at room temperature and to be closed when the lamp reaches ts stabilized operating condition to short circuit the oxidizable element. If the outer envelope is broken, the temperature in the area of the switch drops and its contacts will open. Current flow will then take place through the oxidizable element which will burn through causing the arc to extinguish. The purpose of the switch in this embodiment is to eliminate power (wattage) dissipation by the oxidizable element during normal lamp operation.

A second embodiment of the oxidizable element design uses a coiled tungsten filament without the parallel connected thermostatic switch. This embodiment, applied to mercury lamps, is currently being produced and marketed under the trademark "Safe-T-Vapor" by the assignee of the subject invention. Measurements, observation and life testing programs of this coiled tungsten filament embodiment of safety elements have revealed certain operational considerations. One such consideration is that starting currents of lamps may reach 2.5 times the operating current values. Therefore, the design of an oxidizable filament must be adjusted to withstand high starting currents. This necessarily leads to a design and choice of filament wire dimension which operates the filament at a relatively low temperature during lamp operation. With normal manufacturing variations, such as filament pitch or stretch due to clamping, the distribution of burn out time can extend over a fairly wide range of time, for example, from less than one minute to about 4 minutes under test conditions where the outer envelope is broken after the lamp has stabilized on a reference ballast with rated input voltage applied throughout the test. Under certain controlled test conditions, for example maintaining the ballast at its reference current after the envelope has broken, the burn out time can be extended even longer.

A second consideration is that during the ignition and initial starting phase of the arc tube of a mercury vapor HID lamp it is possible to obtain supply current rectification. Rectification can easily occur due to momentary lack of emission of one or both of the electrodes. Since the ballasts on which the lamps operate are magnetic, inductive devices, they present no significant impedance to d.c. current components, and momentary extremely high currents can therefore flow through the lamp. Filament design must therefore allow for these high currents by reducing the operating temperature of the filament. This directly leads to extended burn-out times mentioned above.

In general, it is desired to improve the burn out time of the oxidizable elements in the sense that it should be more predictable and controllable and also made relatively short. Typical design goals are a 1 to 2 minute burn out time to be obtained for lamps made by normal manufacturing procedures which operate under the wide variety of field service conditions encountered due to the existence of a large number of ballasts with different operating characteristics.

It is therefore an object of the present invention to provide safety arrangements to extinguish the arc of an HID lamp when its outer envelope has been broken.

A further object is to provide a switching means operating with an oxidizable element to extinguish the arc of an HID lamp after its envelope has been broken.

An additional object is to provide an HID lamp in which means are provided to withstand the increased current encountered during lamp starting.

Another object is to provide HID lamps with novel safety arrangements which can withstand high starting currents and which open after the lamp has assumed normal operating status, the safety arrangments also controlling an oxidizable element which will burn through when the lamp envelope breaks to extinguish the arc.

Still a further object is to provide a temperature sensitive safety element for an HID lamp which is responsive to the temperature sensed when the outer envelope breaks.

Yet an additional object is to provide a pressure sensitive safety element for an HID lamp which is responsive to a pressure change when the outer envelope breaks.

BRIEF DESCRIPTION OF DRAWINGS

Other objects and advantages of the present invention will become more apparent upon reference to the following specification and annexed drawings in which.

BRIEF DESCRIPTION OF THE INVENTION

Figure 1:
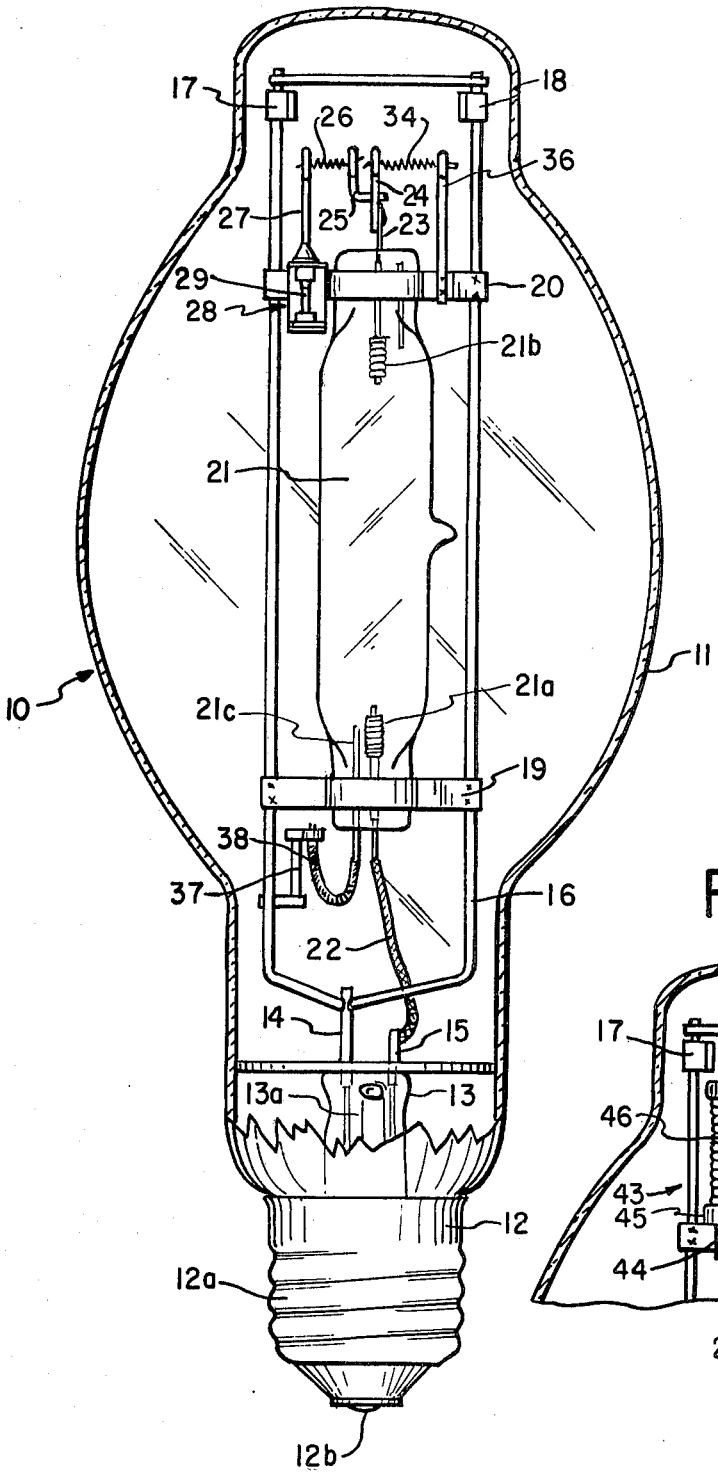
FIG. 1 is an elevational view of a preferred embodiment of the lamp according to the invention utilizing a thermostatic switch.

The present invention relates to improvements in the safety arrangements of our aforesaid application which improve (reduce) the burn out time of the oxidizable element and/or increase the reliability of the safety element. In accordance with the invention, several types of switching arrangements are utilized which react to either a temperature or pressure change within the outer envelope of an HID lamp.

In several embodiments of the invention, the protective devices are used alone or in combination with an oxidizable filament for the purpose of: (a) preventing surge or high currents during the lamp starting phase from damaging the filament consequently shortening lamp life; and (b) through (a) above preventing short lamp life but at the same time allowing an increase in filament operating temperature thus reducing the burn out time and narrowing the distribution of burn out times after outer envelope breakage.

In a preferred embodiment of the invention a first oxidizable element is placed in series with the current supply to the arc tube and a thermostatic switch with a series connected second filament are electrically connected in parallel with the first filament. When the lamp starts, the thermostatic switch is closed so that said second filament is in parallel with the first and the high starting current divides between the two filaments. When the lamp reaches normal operating temperature the switch opens and the second filament is taken out of the circuit. Upon breakage of the outer envelope with the lamp operating and the switch open, all of the arc tube current passes through the first filament causing it to burn out and extinguish the arc. The lamp will then cool causing the switch to close at which time all of the current passes through the second filament causing it to burn out. If the outer envelope breaks during starting while the thermostatic switch is closed, there will be only partial oxidation of the two filaments. The arc will still be struck and heat the switch causing it to open so that the first filament will receive all of the current. This causes the first filament to burn through to extinguish the arc. Subsequent cooling of the lamp allows the switch to close at which time all current passes through the second filament and causes it to burn out.

In a second embodiment, a switch sensitive to gas pressure is provided which is connected in parallel with a filament, the parallel connected filament and switch being connected in series with the arc tube. The switch is normally closed during lamp starting and short circuits the filament. As the lamp heats, increasing the pressure in the outer envelope, the switch opens placing the filament in the circuit. If the envelope breaks during lamp operation, the current flowing through the filament in the presence of air causes it to burn through and remove the current from the arc tube. If the envelope breaks before or during starting, the switch is subjected to a high pressure and opens so that the filament receives all of the lamp current. The filament will then burn through to extinguish the arc.

In still a further embodiment, a normally closed pressure sensitive switch is provided in series with the arc tube current supply. When the envelope breaks the switch opens and removes the current from the arc tube.

FIG. 1 shows a typical 400 watt mercury vapor HID lamp 10 incorporating a preferred embodiment of the device of the present invention for extinguishing the discharge. It should be understood, of course, that the invention is applicable to other types of lamps using other types of arc producing materials. The lamp includes a generally tubular outer envelope 11 having a bulbous central portion with a conventional base 12 attached to its bottom. The base has the usual electrical contacts 12*a*, 12*b*. Extending inwardly from the base 12 and inside of the envelope 11 is a stem 13 with tubulation 13*a*. A pair of stiff lead-in wires 14 and 15 in electrical conducting relation with the respective base contacts 12*a*, 12*b* extend upwardly from stem 13. Welded to the lead-in wire 14 is a frame wire 16. Two-top springs 17 and 18 are welded to the frame wire 16 to give strength to the completed mount within the outer envelope 11.

Figure 1A:
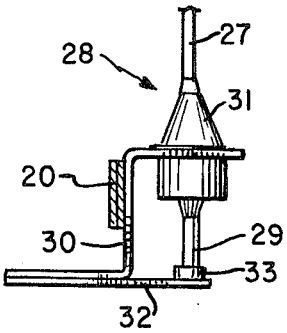
FIG. 1A is a detailed view of the thermostatic switch assembly used with the lamp of FIG. 1.

A pair of metal arc tube supports 19 and 20 are welded to frame wire 16 near its top and bottom and they support an arc tube 21 of quartz or other suitable material. The main electrode lead wire 22 for electrode 21*a* of quartz arc tube 21 is welded to lead in wire 15. The other main electrode 21*b* has its lead wire 23 welded to a filament clamp 24. A second filament clamp 25 is welded to the first. One end of a first filament 26 is held by clamp 25 and the opposite end of this filament is clamped by a third filament clamp 27 which is welded to the contact rod 29 of a thermostatic switch assembly 28. The switch assembly 28, which is shown in detail in FIG. 1A, has a platform 30 which is welded to arc tube support 20. Contact rod 29 is electrically insulated from switch platform 30 by an insulator 31 of ceramic or other suitable material. A thermostatic switch blade 32 is welded to the bottom of switch platform 30 and a contact 33 riveted to blade 32 to make contact with the end of contact rod 29. The pressure between contact 33 and contact rod 29 is adjusted to obtain the proper thermostatic switch opening time during lamp warm-up. The thermostatic switch is constructed so that the switch is closed when the lamp is cool and opens when the arc tube has been or is operating to bring the lamp up to a predetermined temperature.

A second filament 34 is clamped between filament clamps 24 and 36 with the latter clamp being welded to arc tube support 20. Filament 34 is in parallel with filament 26 between the support frame 16, which is connected to lead in wire 14, and the main arc tube electrode 21*b*. Filament 26 can be placed into or taken out of the parallel circuit by the operation of thermostatic switch 28. A starting resistor 37 has one end welded to frame wire 16 and its other end connected to arc tube starting electrode 21*c* through a connecting wire 38.

The operation of the lamp is as follows. When voltage is applied to lead-in wires 14 and 15, through the proper ballast (not shown), current flows through arc tube 21 (after the initial ionization from starting electrode 21*c* to its adjacent main electrode 21*a*) and through the parallel combination of filaments 26 and 34 (the former being in series with thermostatic switch 28) returning to lead wire 14.

In a preferred embodiment, filaments 26 and 36 have the same electrical characteristics. Hence, the normally high currents associated with the ignition phase of the arc tube 21 will divide equally between the parallel filament circuits. As the arc tube warm up continues thermostatic switch blade 32 will open eliminating filament 26 from the circuit during lamp operation.

There are two modes of outer envelope failure with respect to lamp operation.

1st mode: Lamp is operating — envelope breaks.

2nd mode: Lamp is off — envelope breaks — lamp is started.

In the first mode since thermostatic switch 28 is open, filament 34 will oxidize and burn through when the outer envelope is broken. This removes the current from arc tube 21. With arc tube 21 extinguished, the thermostatic switch blade 32 cools and closes igniting tube 21 again through filament 26. Filament 26 will then carry high current, oxidize and burn through, permanently extinguishing the discharge.

In the second mode, the thermostatic switch 28 is closed and both filaments 26 and 34 carry a proportional amount of lamp starting current. The temperature of each filament, however, is low and only partial oxidation occurs. As the arc tube warm up continues (even in air) the thermostatic switch 32 opens subjecting-filament 34 to the complete arc tube current. This raises the temperature of this filament causing it to completely oxidize and burn through. Subsequent arc tube cooling allows the thermostatic switch to close again reigniting the tube and causing high current flow through filament 26. This filament will then burn through, permanently extinguishing the discharge.

Test results of 400 watt mercury lamps constructed according to this embodiment are compared to the embodiment employing the single filament construction described in the prior copending application.

envelope failure the embodiment encompassing the invention disclosed here are below two minutes. Starting tests conducted on lamps constructed to the embodiment of FIG. 1 have shown an increase in the number of starts without failure by a factor of at least two over the prior embodiment of lamp with a single filament.

The data presented above relates to lamps in which the two filaments had substantially equal electrical properties. Lamp designs wherein the filaments have different characteristics may be employed to try and achieve optimum burn-out times without sacrificing ability to withstand starting pulses.

A normally closed thermostatic switch 28 without a filament 26 in series with it but in parallel with filament 34 would initially short circuit filament 34 and completely eliminate any starting current pulses. This construction would not produce the desired safety feature since after outer envelope breakage and burn through of filament 34, and upon arc tube cooling, the thermostatic switch would close, complete the circuit again, and re-ignite the discharge. Continuous on-off cycling would occur as the switch closes and opens. Only destruction of the switch or other lamp circuit components would eventually extinguish the discharge permanently.

Figure 2:
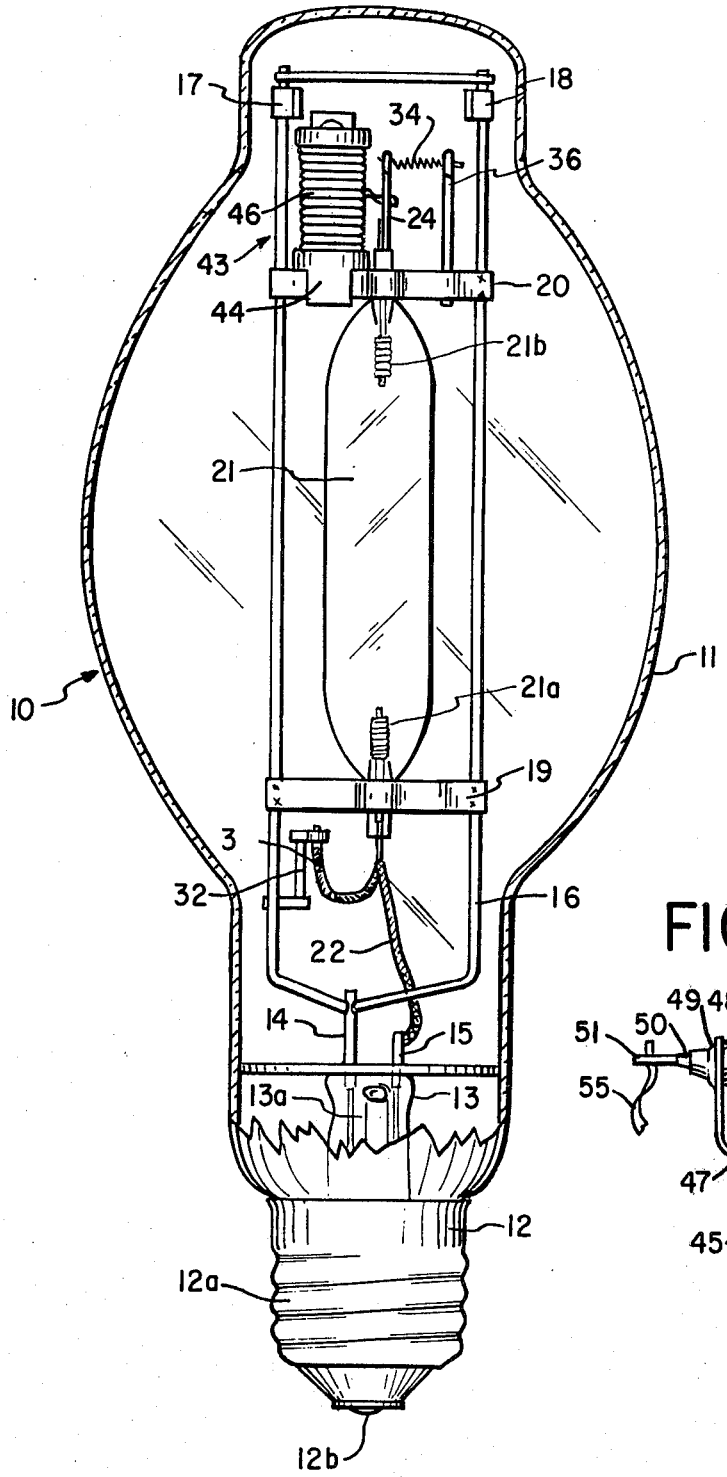
FIG. 2 is an elevational view of another embodiment of lamp utilizing a pressure sensitive switch.

FIG. 2 shows a lamp incorporating another embodiment of a safety device. The embodiment of FIG. 2 has a safety device which initially short circuits the oxidizable filament and opens during lamp warm up and re-

| | Single Filament Construction | Parallel Filament plus Thermo-Static Switch Construction | |
|---|---|---|---|
| Filament Wire Weight | 180 mg/200 mm | Filament 34<br>Filament 26 | 147.5 mg/200mm<br>147.5 mg/200mm |
| Filament Temperature at 7.5 amperes max. starting current | 2985° K | Filament 34<br>Filament 26 | 2160° K<br>2160° K |
| Filament Temperature at 3.2 amperes operating current | 1615° K | Filament 34 | 1935° K |
| Filament Wattage Dissipation During Lamp Operation | 10 watts | Filament 34 | 12 watts |
| Filament Burn-Out Time (1st mode) | 2.5 minutes | Filament 34<br>Filament 26 | 0.4 minutes<br>0.5 minutes |
| Filament Burn-Out Time (2nd mode) | 0.8 minutes | Filament 34<br>Filament 26 | 0.17 minutes<br>0.43 minutes |
| Total Arc Discharge Operating Time (1st mode) | 2.5 minutes | Filament 34 burn out time<br>Filament 26 burn out time<br>Total time<br>Switch opening time | 0.4 minutes<br>0.5 minutes<br>0.9 minutes<br>1.0 minutes |
| Total Arc Discharge Operating Time (2nd mode) | 0.8 minutes | Filament 34 burn out time<br>Filament 26 burn out time<br>Total time | 0.17 minutes<br>0.43 minutes<br>1.6 minutes |

It is of interest to specify the method of test for obtaining burn out and arc discharge operating times shown in the above table. Also, the proper interpretation of these times requires explanation. In determining the above data, all burn out time and operating time data of a group of test lamps were plotted as a cumulative frequency distribution on probability graph paper. The times in the table above were obtained from the point of intersection of the plotted data with the intercept for 95 percent of the number of lamps tested. The lamps were operated on a reference ballast with constant reference input voltage applied.

The total discharge operating time values in the above table clearly show that for both modes of outer mains open if the outer envelope is broken. This is accomplished by the use of a switch which is sensitive to gas presssure senitive switch. The basic construction of the lamp of FIG. 2 is similar to that of FIG. 1 and the same reference numerals are used for the same elements. In the lamp of FIG. 2 the arc tube 21 is rotated by 90 degrees from the lamp of FIG. 1 to gain space for placement of the pressure sensitive switch. The switch is shown in detail in FIG. 2A.

In the lamp of FIG. 2, there is only a single oxidizable element 34 and its operation is controlled by a pressure sensitive switch 43 which is mounted on the arc tube support 20. Switch assembly 43 includes a bracket 44 welded to the lower flange 45 of a hermetically sealed and evacuated bellows assembly 46 and to the arc tube support 20.

A sub-assembly formed by a leaf spring member 47, ceramic insulator 48, retaining ring 49, two locating eyelets 50 and a contact rod 51 is welded to the lower flange 45. Ther ceramic insulator 48 passes through a hole near the end of the leaf spring 47 and is held to the latter by the toothed retaining ring 49. Contact rod 51 passes through a central hole in the insulator 48 and is located with respect to it with the two eyelets 50 welded to the contact rod 51. The rounded front of the contact rod 51 is in contact with a rounded upper flange 52 of the bellows 46. Contact force between the rod 51 and bellows flange 52 can be preadjusted by bending and shaping the "dog leg" section of the leaf spring 47. Such adjustments are routinely performed on devices such as thermostatic switches and can be measured (in grams, for example) by means of commercially available tension gauges. A lead 55 is welded to rod 51 and to the clamp 24. The bellows switch 43 shorts filament 34 when the bellows 46 is extended so that its flange 52 engages contact rod 51.

The bellows 46 is used to transduce pressure differentials into length changes. In the embodiment of FIG. 2, the hermetically sealed and evacuated (vacuum inside) bellows assumes a length $l_1$, when the external pressure (pressure surrounding the outside surfaces of the bellows) is atmospheric (760 torr). If the external pressure should be reduced to a vacuum the bellows would expand to its full length $l_2$, where:

$$l_2 > l_1$$

Intermediate external pressure between vacuum and 760 torr will cause the bellows to assume intermediate bellows lengths.

The space between the arc tube 21 and the outer glass envelope 11 of HID lamps is occupied either by an inert gas, usually nitrogen filled to a certain pressure, or vacuum. Either nitrogen fill or a vacuum will prevent oxidation of arc tube leads and mount parts during lamp operation but the choice and requirement of either is determined by interrelated design parameters including: (1) arc tube fill component vapor pressures, (2) arc tube loading, (3) lamp warm up time, and (4) ability to withstand arc-over between mount parts. Without describing the technical details of high pressure sodium (HPS) or metal halide (MH) lamp design, a vacuum is generally necessary in the space between the arc tube and the outer envelopes of these lamps to prevent heat losses in the arc tube and achieve the proper vapor presssures of the fill components necessary to optimize light producing efficacy. To maintain good vacuum, gettering is necessary to absorb gases evolving from the mount parts and glass envelope during operation.

The arc tube of a mercury lamp contains only mercury (except for the argon starting gas) which is a high vapor pressure element. Arc tube surface temperatures can therefore be maintained low enough at the coolest point (600° C) to achieve complete evaporation of the mercury fill dose. This allows a nitrogen atmosphere to be introduced in the space between the arc tube and outer envelope. The fill pressure of the nitrogen is adjusted to allow reasonably short warm up time (time for the light output to reach maximum) and high resistance to arc-over between the mount parts upon the application of high voltages encountered in certain street lighting applications. Generally the higher the fill pressure, the slower the warm-up, and the greater the ability to withstand high voltages. In mercury HID lamps with an internal tungsten filament or filaments, it is advantageous to introduce the highest fill pressure possible to reduce tungsten evaporation. For 400 watt mercury lamps as shown in FIG. 2, a fill pressure of 500 torr is chosen. The bellows length for a lamp with 500 torr is then $l_3$, where:

$$l_1 < l_3 < l_2$$

Figure 2A:
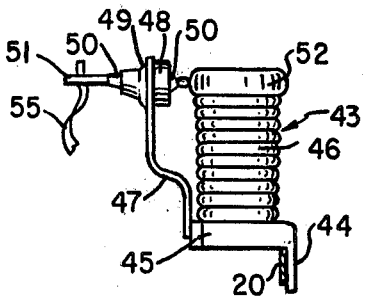
FIG. 2A is a detailed view of the switch of the lamp of FIG. 2.

Length $l_3$ is shown in FIGS. 2 and 2A. At this point during the operating cycle, the rounded end of contact rod 51 is in contact with the upper flange 52 of bellows 46 thereby short circuiting filament 34 through mount 20. After starting, the lamp will increase in wattage and the attendant temperature increase will increase the pressure of the nitrogen fill gas. Bellows 46 will contract from its $l_3$ length until at a pressure of about 600 torr length $l_4$ is reached, where $$l_4 < l_3$$

At length $l_4$, the bellows flange 52 is out of contact with rod 51. Therefore, filaments 34 is not short circuited and is in series with arc tube 21. Further pressure increase will further contract the bellows length to $l_5$, where:

$$l_5 < l_4 .$$

At any time, either during operation or before starting, if the outer envelope should be broken the external pressure seen by the bellows will be atmospheric. This will cause the bellows to contract to and remain contracted to $l_1$. After filament 34 has oxidized and burned through the arc tube circuit is permanently interrupted.

The table below lists the bellows lengths with respect to processing and lamp operation and in order of decreasing length of the bellows.

| L | Description | Pressure in Outer Envelopes |
|---|---|---|
| $l_2$ | Lamp is evacuated and processed | 0 torr (vacuum) |
| $l_3$ | Lamp is filled with nitrogen | 500 torr (fill pressure) |
| $l_4$ | Lamp after starting | 600 torr (approximately) |
| $l_1$ | Lamp mount is assembled | 760 torr (atmospheric) |
| $l_1$ | Lamp mount is sealed into glass envelope | 760 torr (atmospheric) |
| $l_5$ | Lamp during operation | 1000 torr (approximately) |

The bellows will contract, close the switch and short the filament 34 at length of $l_3$. At a pressure somewhat higher than that which causes length $l_3$, for example, at pressures in the range of from about 520–540 mm the bellows will change its length to that which will cause the switch to open. Typically at its full expanded length $l_2$, a bellows as shown in FIGS. 2 and 2A is 0.75 inch long with $(l_2 - l_5)$ equal to 0.150 inch, where $l_5$ is a normal minimum length that is encountered. Diameters of the bellows flanges are typically 0.50 inch. MONEL is an excellent bellows and flange material because of its ability to withstand high temperature (temperatures of approximately 300° C have been measured in operating lamps at the bellows location shown in FIG. 2) and low fatigue factor. Other materials such as phosphor bronze and beryllium copper are possible. Stainless steel has the necessary temperature reliability but it is difficult to spot weld sub-assebmly parts to it. An excellent material for the leaf spring 47 is MONEL which is routinely used in HID lamps for spring supports. MONEL is known to maintain its flexibility throughout long lamp life. A preferred material for the contact rod 51 is tungsten or a mixture of 85% tungsten, 15% silver, the latter having improved thermal conductivity. Bracket materials can be standard nickel, nickel plated steel or an alloy of commercially available nickel-iron.

The operation of the lamp of FIG. 2 is described as follows. During the lamp ignition and starting phase the pressure switch 43 is closed and no current can flow through the short circuited filament 34. Starting and rectification pulses therefore can not cause any filament damage. As the lamp warms up, the pressure in the outer envelope, nitrogen in the example being described, increases causing the bellows to contract to a shorter length thereby opening the switch. Current will now flow through filament 34 and continue to flow during lamp operation. When the lamp is turned off the temperature and nitrogen pressure will decrease causing the bellows to expand in length so that the pressure switch will close again and be ready for the next starting period.

When the outer envelope is broken during lamp operation, when current is flowing through the filament, the filament will burn through. When the outer envelope is broken while the lamp is off atmospheric pressure now surrounds the bellows so that it will be contracted and the switch will be open. Subsequent starting will send current directly through filament 34 burning it through, and permanently extinguishing the discharge.

As a matter of practical design, the end of contact rod 51 and the upper bellows flange 52, in contact with the rod end, are rounded to prevent "hang-up" during the bellows lengths excursions. Also, bracket 45 and its anchoring to the lower flange 44 assures that length changes are limited to and controlled only by movement of the upper flange 52.

Figure 3:
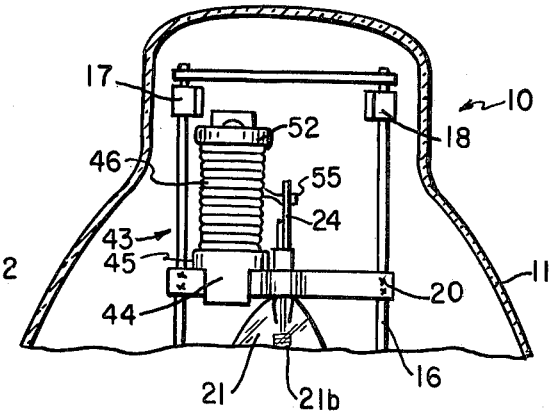
FIG. 3 is an elevational view of a modification of the lamp of FIG. 2.

For HPS and MH lamps a pressure sensitive switch device without the parallel filament will be sufficient to permanently extinguish the discharge when the outer bulb is broken. This is shown in FIG. 3 where the lead wire 55 is connected to the mount 24. Here the filament 34 and mount 36 are omitted and current is supplied to main electrode **21*b* through the pressure sensitive switch 43. The pressure sensitive switch assembly is the same as in FIGS. 2 and 2A**.

In the case of HPS and MH lamps there is a vacuum condition in the outer envelope. The length of the leaf spring member is designed to assure contact between the rod and bellows flange in the vacuum condition. Since during lamp operation the vacuum in the outer envelope is maintained switch contact is also maintained throughout lamp operation and current is supplied to the arc tube. When the outer envelope is broken the switch bellows will contract, break the contact, and open the circuit permanently.

For mercury lamps it is also possible to use a pressure switch only. However, the fill pressure will have to be reduced in order to be certain the pressure during operation does not exceed approximately 600 torr. Higher operating pressures will reduce the length differential between the 760 torr displacement (contact must be open) and the operating pressure displacement (contact must still be closed) below a practical and reliable value. 175 watt and smaller wattage mercury lamps, for example, are filled with 250 torr and lower $N_2$ pressure to allow the tube to warm up and evaporate the entire and required mercury dose. Operating $N_2$ pressures in these lamps reach about 500 torr and less. Pressure sensitive switches alone can therefore be used for breaking the circuit should the outer envelope be broken.

What is claimed is:

1. An electric lamp comprising an outer envelope of material which is transmissive to visible light and which is normally sealed to the atmosphere, arc tube discharge means within said outer envelope for producing a predetermined radiation spectrum of energy upon electrical current being supplied thereto, said outer envelope blocking at least a portion of the radiation spectrum produced by said arc tube discharge means, means for supplying electrical current to said arc tube discharge means to produce the arc therein, said current supplying means comprising (a) first means within said outer envelope comprising an oxidizable element which burns through in the presence of air when the outer envelope is broken and being electrically connected in series with said arc tube discharge means, and (b) second means within said outer envelope including switching means electrically connected in parallel with said first means, said switching means being closed during lamp starting and said switching means opening upon the lamp reaching normal operating conditions with said outer envelope intact.

2. An electric lamp as in claim 1, wherein said switching means of said second means comprises temperature sensitive switch means.

3. An electric lamp as in claim 1 wherein said first named oxidizable element comprises a filament.

4. An electric lamp as in claim 1 wherein said second means includes resistive means in series with said switching means.

5. An electric lamp as in claim 4 wherein said resistive means of said second means comprises a further oxidizable element electrically connected in series with said switching means.

6. An electric lamp as in claim 5 wherein said switching means comprises temperature sensitive switch means.

7. An electric lamp as in claim 5 wherein said switching means comprises pneumatic pressure sensitive switch means.

8. An electric lamp as in claim 7 wherein said pneumatic pressure sensitive switch means includes a bellows.

9. An electric lamp as in claim 5 wherein said oxidizable elements of said first and second means have substantially the same electrical resistance so that the arc tube current divides substantially equally between the two oxidizable elements when said switch means is closed during lamp starting.

10. An electric lamp as in claim 4 wherein said resistive means of said second means has substantially the same resistance as said oxidizable element of said first means so that the arc tube current divides substantially equally between said oxidizable element and said resistive means when said switch means is closed during lamp starting.

11. An electric lamp comprising an outer envelope of material which is transmissive to visible light and which is normally sealed to the atmosphere, arc tube discharge means within said outer envelope for producing a predetermined radiation spectrum of energy upon electrical current being supplied thereto, said outer envelope blocking at least a portion of the radiation spectrum produced by said arc tube discharge means, means for supplying electrical current to said arc tube discharge means to produce the arc therein, said current supplying means including pneumatic pressure sensitive switch means located within said outer envelope electrically connected in series with said arc tube discharge means, said pressure switch means being normally closed when the outer envelope is intact and responding to a change in gas pressure to open when said outer envelope is broken.

12. An electric lamp as in claim 11 wherein said pneumatic pressure sensitive switch means directly breaks the current circuit to said arc tube discharge means upon opening of said switch.

13. An electric lamp as in claim 12 wherein said pneumatic pressure sensitive switch means includes a bellows.

14. An electric lamp comprising:

an outer envelope of material which is transmissive to visible light and which is normally sealed to the atmosphere, arc tube discharge means within said outer envelope for producing a predetermined radiation spectrum of energy upon electrical current being supplied thereto, said outer envelope blocking at least a portion of the radiation spectrum produced by said arc tube discharge means, means for supplying electrical current to said arc tube discharge means to produce the arc therein, said current supplying means including pneumatic pressure sensitive switch means located within said outer envelope electrically connected in series with said arc tube discharge means, and an oxidizable element electrically connected in parallel with said switch means, said pneumatic pressure sensitive switch means responding to a change in gas pressure and opening when the envelope is broken so that the current passes through said oxidizable element to cause it to burn through and thereby extinguish the arc.

15. An electric lamp as in claim 14 wherein said pneumatic pressure sensitive switch means also opens when the outer envelope is intact upon the gas pressure in the outer envelope reaching a predetermined pressure.

16. An electric lamp as in claim 15 wherein said predetermined gas pressure is produced in said envelope when the lamp is operating at about its normal temperature.

17. An electric lamp as in claim 14 wherein said pneumatic pressure sensitive switch means includes a bellows.

18. An electric lamp comprising an outer envelope of material which is transmissive to visible light and which is normally sealed to the atmosphere, arc tube discharge means within said outer envelope for producing a predetermined radiation of spectrum of energy upon electrical current being supplied thereto, said outer envelope blocking at least a portion of the radiation specturm produced by said arc tube discharge means, means for supplying electrical current to said arc tube discharge means to produce the arc therein, said current supply means comprising (a) first means within said outer envelope comprising an oxidizable element which burns through in the presence of air when the outer envelope is broken electrically connected in series with said arc tube discharge means, and (b) pneumatic pressure sensitive switch means within said outer envelope electrically connected in parallel with said first means, said switch means being closed during lamp starting and opening upon the lamp reaching normal operating conditions with said outer envelope intact.

* * * * *